US007983782B2

(12) United States Patent
Nomura et al.

(10) Patent No.: US 7,983,782 B2
(45) Date of Patent: Jul. 19, 2011

(54) SEWING MACHINE AND SPOOL PIN STAND THEREFOR

(75) Inventors: Yutaka Nomura, Nagoya (JP); Hiroyuki Suzuki, Nagoya (JP); Chikahisa Noguchi, Nagoya (JP); Masaru Jimbo, Kasugai (JP); Eiichi Ito, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1145 days.

(21) Appl. No.: 11/729,855

(22) Filed: Mar. 30, 2007

(65) Prior Publication Data

US 2007/0227421 A1 Oct. 4, 2007

(30) Foreign Application Priority Data

Apr. 3, 2006 (JP) ..... 2006-101561

(51) Int. Cl.
*G06F 7/66* (2006.01)

(52) U.S. Cl. ..... 700/136

(58) Field of Classification Search ..... 700/136–138; 112/227, 231, 273, 278, 302
See application file for complete search history.

(56) References Cited

U.S. PATENT DOCUMENTS

| | | | | |
|---|---|---|---|---|
| 4,166,423 | A * | 9/1979 | Brienza et al. | 112/278 |
| 4,301,753 | A | 11/1981 | Meier | |
| 4,869,188 | A * | 9/1989 | Hyodo | 112/445 |
| 5,078,067 | A * | 1/1992 | Nakashima | 112/278 |
| 5,794,552 | A * | 8/1998 | Owaki | 700/138 |
| 6,170,418 | B1 * | 1/2001 | Jaeger | 112/278 |
| 7,028,626 | B2 * | 4/2006 | Sakakibara | 112/278 |
| 2005/0188906 | A1 * | 9/2005 | Goto et al. | 112/102.5 |

FOREIGN PATENT DOCUMENTS

| | | |
|---|---|---|
| JP | Y2 60-20386 | 6/1985 |
| JP | A 62-34592 | 2/1987 |
| JP | A 62-44290 | 2/1987 |
| JP | U 62-18073 | 2/1987 |
| JP | U 62-50573 | 3/1987 |
| JP | A 2001-54692 | 2/2001 |

* cited by examiner

*Primary Examiner* — Gary L. Welch
*Assistant Examiner* — Nathan E Durham
(74) *Attorney, Agent, or Firm* — Oliff & Berridge, PLC

(57) ABSTRACT

A sewing machine includes a spool pin stand having spool pins to which thread spools are attachable and seats corresponding to the spool pins, respectively, thread passage defining members located on a thread passage, a sewing data storage unit storing sewing data including at least thread color information about colors of the needle threads, thread supply display units which are located on the spool pin stand so as to correspond to the spool pins respectively, the thread supply display units being configured to produce light which transmits through at least ones of the spool pins and the seats and displaying the thread colors in a color-variable manner, respectively, and a thread color information control unit controlling the thread supply display units based on the thread color information so that thread colors corresponding to the spool pins are displayed by the thread supply display units, respectively.

13 Claims, 12 Drawing Sheets

| SEWING NEEDLE NO. | FIRST THEAD COLOR | SECOND THREAD COLOR | SPOOL PIN STAND LAMP | THREAD TENSION REGULATOR LAMP |
|---|---|---|---|---|
| 1 | ORANGE | WHITE | FIRST SPOOL PIN LAMP | FIRST THREAD TENSION LAMP |
| 2 | RED | ——— | SECOND SPOOL PIN LAMP | SECOND THREAD TENSION LAMP |
| 3 | BLUE | ——— | THIRD SPOOL PIN LAMP | THIRD THREAD TENSION LAMP |
| 4 | GREEN | ——— | FOURTH SPOOL PIN LAMP | FOURTH THREAD TENSION LAMP |
| 5 | YELLOW | ——— | FIFTH SPOOL PIN LAMP | FIFTH THREAD TENSION LAMP |
| 6 | PURPLE | ——— | SIXTH SPOOL PIN LAMP | SIXTH THREAD TENSION LAMP |

FIG. 6

| | | R | G | B |
|---|---|---|---|---|
| 1 | ORANGE | 255 | 100 | 0 |
| 2 | WHITE | 240 | 240 | 240 |
| 3 | RED | 237 | 23 | 31 |
| | | | | |
| | | | | |
| 15 | YELLOW | 255 | 255 | 0 |
| 16 | CREAM-YELLOW COLOR | 255 | 240 | 141 |
| | | | | |

FIG. 7

| SEWING SEQUENCE | THREAD COLOR |
|---|---|
| 1 | ORANGE |
| 2 | RED |
| 3 | BLUE |
| 4 | GREEN |
| 5 | YELLOW |
| 6 | PURPLE |
| 7 | WHITE |
| ⋮ | ⋮ |

FIG. 8

SEWING MACHINE AND SPOOL PIN STAND THEREFOR

CROSS-REFERENCE TO RELATED APPLICATIONS

This application is based upon and claims the benefit of priority from the prior Japanese Patent Application No. 2006-101561 filed on Apr. 3, 2006, the entire contents of which are incorporated herein by reference.

BACKGROUND

1. Technical Field

The present disclosure relates to a sewing machine provided with a spool pin stand on which a display device is mounted for displaying a color of needle thread used for sewing.

2. Description of the Related Art

Multineedle sewing machines have conventionally been put to practical use in order that colorful embroidery patterns may be sewn using embroidery threads of a plurality of colors. One of the multineedle sewing machines comprises a spool pin stand having a plurality of spool pins to which thread spools are attachable respectively and a needle bar mechanism including a plurality of, for example, six, nine or twelve needle bars which are aligned and have lower ends to which sewing needles are attached respectively. The multineedle sewing machine also comprises a needle bar switching mechanism which selects the needle bar being driven vertically from a plurality of the needle bars, a plurality of thread tension regulators applying tension to respective needle threads and a plurality of thread take-ups. When embroidery sewing is to be carried out using the multineedle sewing machine, an operator attaches needle thread spools of a plurality of thread colors necessary for embroidery sewing to the spool pins respectively and thereafter, passes a needle thread drawn from the thread spool through the corresponding thread tension regulator and thread take-ups. The needle thread is finally passed through an eye of the sewing needle.

On the other hand, a thread passage along which a needle thread drawn from each thread spool is supplied to a sewing needle is generally determined as a threading passage for every spool pin. Each needle thread is passed along the thread passage through a thread tension regulator so that the needle thread is prevented from coming into contact with and being entangled with another needle thread. However, the spool pins and thread tension regulators come closer to one another as the number of sewing needles becomes larger. As a result, there is a problem that the threading passage is easily misselected. In view of this problem, various proposals have been made in order that the needle thread may be prevented from being erroneously passed.

For example, JP-A-2001-54692 discloses a thread guide device for a multineedle embroidery sewing machine, in which twelve light-emitting diodes are provided on a thread guide passage (thread passing passage) near a plurality of thread guide tension discs and a plurality of thread tension members (corresponding to thread tension regulators) both corresponding to twelve needle bars respectively. When the operator operates a selection key on an operation panel to select a needle bar number, the light-emitting diode on the thread guide passage corresponding to the selected needle bar is turned on, so that the operator can be prevented from error in thread passing.

However, the light-emitting diodes are disposed on the thread guide passage near the thread guide tension discs and the thread tension members both corresponding to the needle bars respectively and one of the light-emitting diodes is merely turned on when the needle thread is passed. Accordingly, the operator cannot clearly determine to which spool pin the thread spool should be attached even though he or she can understand a passage along which the needle thread is passed. Consequently, there is a possibility that the operator may attach a thread spool to an erroneous spool pin. In this case, the needle thread cannot be drawn from the thread spool smoothly such that sewing cannot be carried out normally.

SUMMARY

Therefore, an object of the present disclosure is to provide a sewing machine provided with a spool pin stand which can attach thread spools of a plurality of thread colors used for sewing without error.

The present disclosure provides a sewing machine comprising a plurality of needle bars provided for a sewing operation using a plurality of needle threads, a spool pin stand having a plurality of spool pins to which a plurality of thread spools corresponding to the needle bars are attachable and a plurality of seats which are provided so as to correspond to the spool pins, respectively, a plurality of thread passage defining members defining a thread passage extending from the spool pin stand to the needle bars, a sewing data storage unit which stores sewing data including at least thread color information about colors of the needle threads, a plurality of thread supply display units which are provided on the spool pin stand so as to correspond to the spool pins respectively, the thread supply display units being configured to produce light which transmits through at least ones of the spool pins and the seats and displaying the thread colors in a color-variable manner, respectively, and a thread color information display control unit which controls the thread supply display units based on the thread color information read from the sewing data storage unit, so that a plurality of thread colors corresponding to the spool pins are displayed by the thread supply display units, respectively.

According to the above-described construction, when the operator selects an embroidery pattern to be sewn, the thread color information display control unit reads thread color information about a needle thread color from sewing data of the embroidery pattern, controlling a plurality of the thread supply display units which are provided on the spool pin stand so as to correspond to a plurality of the spool pins respectively, so that a plurality of thread colors corresponding to the respective spool pins are displayed. Consequently, the operator can easily but exactly attach a thread spool having the same thread color as displayed on the display unit to the spool pin for which the thread color is displayed, without erroneously selecting another spool pin.

The disclosure also provides a spool pin stand for use with a sewing machine including a plurality of needle bars provided for a sewing operation using a plurality of needle threads. The spool pin stand comprises a plurality of spool pins to which a plurality of thread spools corresponding to the needle bars are attachable, respectively and a plurality of thread color display units which display thread colors in a color-variable manner so that the thread colors correspond to the spool pins, respectively, the thread supply display units being configured to produce light which transmits through at least ones of the spool pins and the seats.

According to the above-described construction, a plurality of the thread color display units are provided on the spool pin stand for displaying the thread colors in the color-variable manner so that the thread colors correspond to the spool pins.

Consequently, the operator can easily but exactly attach a thread spool having the same thread color as displayed on the display unit to the spool pin for which the thread color is displayed, without erroneously selecting another spool pin.

BRIEF DESCRIPTION OF THE DRAWINGS

Other objects, features and advantages of the present disclosure will become clear upon reviewing the following description of the illustrative examples with reference to the accompanying drawings, in which:

FIG. 6 explains data construction of a needle bar thread color table;

FIG. 7 explains data construction of a colored light table;

FIG. 8 explains data construction of a sewing thread color memory;

DETAILED DESCRIPTION OF EMBODIMENTS

Figure 1:
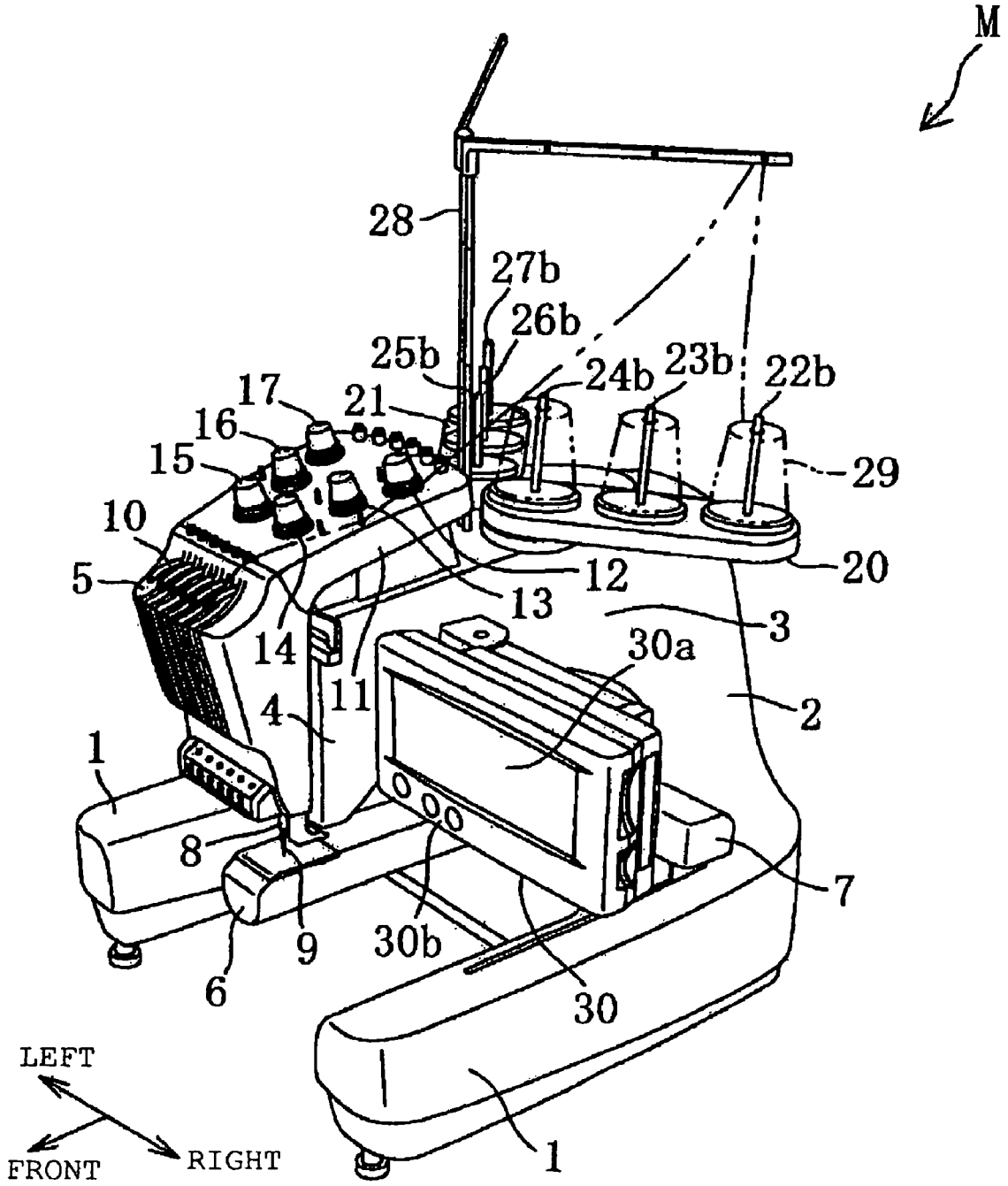
FIG. 1 is a perspective view of the whole multineedle embroidery sewing machine of a first illustrative example in accordance with the present disclosure.

One illustrative example of the present disclosure will be described with reference to FIGS. 1 to 10. Referring to FIG. 1, a multineedle embroidery sewing machine M of the example is shown. The multineedle embroidery sewing machine M comprises a pair of right and left support legs 1, a pillar 2 standing on rear ends of the support legs 1 and an arm 3 extending frontward from an upper part of the pillar 2. The multineedle embroidery sewing machine M further comprises a cylinder bed 6 extending frontward from a lower end of the pillar 2, a carriage driving mechanism (not shown) moving an embroidery frame (not shown) via a carriage 7 in the X direction (a right-left direction) and the Y direction (a front-rear direction) perpendicular to the X direction and a threading mechanism (not shown) passing a thread through a needle eye of a sewing needle 9 as will be described later. Since each of the carriage driving mechanism and the threading mechanism has an ordinary construction, the description of each mechanism will be eliminated.

The arm 3 includes a head 4 to which a needle bar case 5 provided with a cover made from a synthetic resin is mounted. The needle bar case 5 has a plurality of, for example, six needle bars 8 which are attached thereto so as to align in the right-left direction. The head 4 further includes six thread take-ups 10 which are aligned in the right-left direction so as to correspond to the needle bars 8 respectively. The needle bars 8 have lower ends to which sewing needles 9 are attached respectively. The needle bar case 5 includes an upper end to which a thread tension frame 11 is fixed so as to be inclined slightly upwardly rearward. The thread tension frame 11 is made from a synthetic resin and provided with six thread tension regulators 12 to 17 corresponding to needle threads to be supplied to the sewing needles 9 respectively. The arm 3 encloses therein a needle bar switching mechanism (not shown) having a needle bar switching motor 64 (see FIG. 4). The cylinder bed 6 encloses in a front end interior thereof a thread cutting mechanism (not shown) cutting a needle thread and a bobbin thread and a rotary hook (not shown).

Upon drive of the needle bar switching motor 64 in changing a needle thread, the needle bar case 5 is moved in the right-left direction together with the thread tension frame 11 by the needle bar switching mechanism so that one of the six needle bars 8 and one of the six thread take-ups 10 are simultaneously switched to respective active positions. Subsequently, the embroidery frame supported on the carriage 7 and a sewing machine motor 63 (see FIG. 4) are driven so that the needle bar 8 and thread take-up 10 both assuming the respective active positions are vertically driven in synchronization with each other. The needle bar 8 and thread take-up 10 form embroidery stitches on workpiece cloth supported on the embroidery frame using needle and bobbin threads in cooperation with the rotary hook in the cylinder bed 6.

A pair of first and second spool pin stands 20 and 21 are provided on a rear half of the top of the arm 3 into a generally V-shaped arrangement as viewed from above. The right, first spool pin stand 20 is provided with three spool pins 22*b* to 24*b* (see FIG. 2) and the left, second spool pin stand 21 is provided with three spool pins 25*b* to 27*b*. Furthermore, the arm 3 is provided with a thread guide 28. In sewing, thread spools 29 are attached to the spool pins 22*b* to 27*b* respectively. Needle threads extending from the thread spools 29 are passed through the corresponding thread tension regulators 12 to 17 and thread take-ups 10 and the like via predetermined thread passages, finally being supplied to the sewing needles 9. The arm 3 is provided with a foldable operation panel 30. The operation panel 30 includes a display 30*a* and a switch group 30*b* further including a needle bar change-over switch (not shown) instructing to change over the needle bar 8 to be vertically driven and a threading switch for instructing automatic threading. A touch panel is provided on the front of the display 30*a*.

Figure 2:
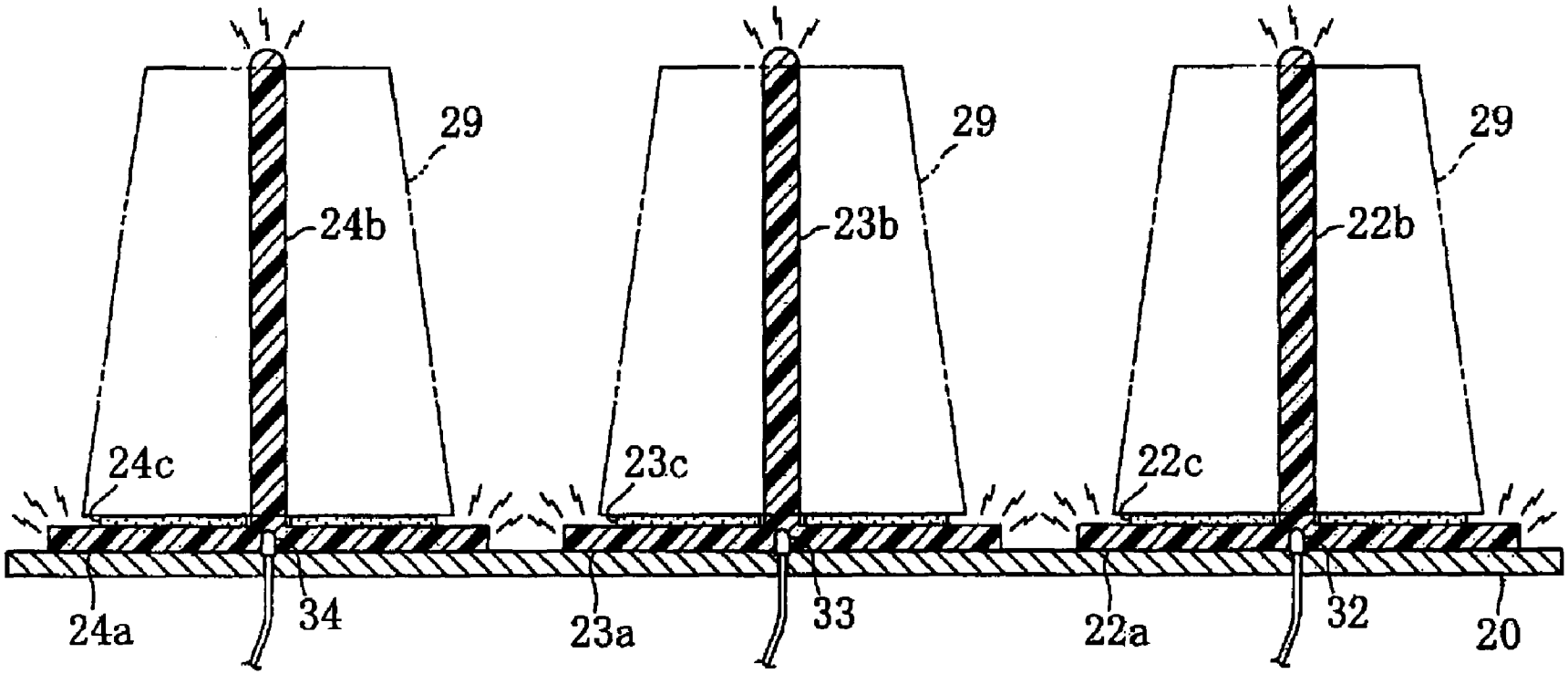
FIG. 2 is a longitudinally sectional front view of a spool pin stand.

The first and second spool pin stands 20 and 21 will now be described. Since the first and second spool pin stands 20 and 21 have the same construction, only the first spool pin stand 20 will be described. Referring to FIG. 2, the first spool pin stand 20 includes three circular seats 22*a* to 24*a* as viewed from above and vertically extending spool pins 22*b* to 24*b* formed integrally on the respective seats. These three pairs of the seats 22*a* to 24*a* and spool pins 22*b* to 24*b* are made from a transparent or translucent synthetic resin. First to third spool lamps 32 to 34 comprising full-color light emitting diodes (LEDs) are embedded in central parts of the seats 22*a* to 24*a*, that is, lower ends of the spool pins 22*b* to 24*b* respectively. Thread spool felts 22*c* to 24*c* are placed on the upper sides of the seats 22*a* to 24*a* so that the thread spools 29 are attached to the spool pins 22*b* to 24*b* stably, respectively.

The first to third spool lamps 32 to 34 produce full-color light when receiving drive signals from a control device 50 as will be described later. The colored light is transmitted to all of the seats 22*a* to 24*a* and thread spools 22*b* to 24*b*, whereupon it appears that the seats 22*a* to 24*a* and the spool pins 22*b* to 24*b* produce light. Accordingly, even when the thread spools 29 have been attached to the spool pins 22*b* to 24*b*, the operator can easily view the colored light through the upper ends of the spool pins 22*b* to 24*b* and the outer circumferences of the seats 22*a* to 24*a*. The other, second spool pin stand 21 has the same construction as described above. More specifically, fourth to sixth spool lamps 35 to 37 comprising full-color LEDs are embedded in lower ends of the spool pins 25*b* to 27*b* respectively. Accordingly, the operator can easily view colored light peculiar to each of the spool pins 25*b* to 27*b*.

Figure 3:
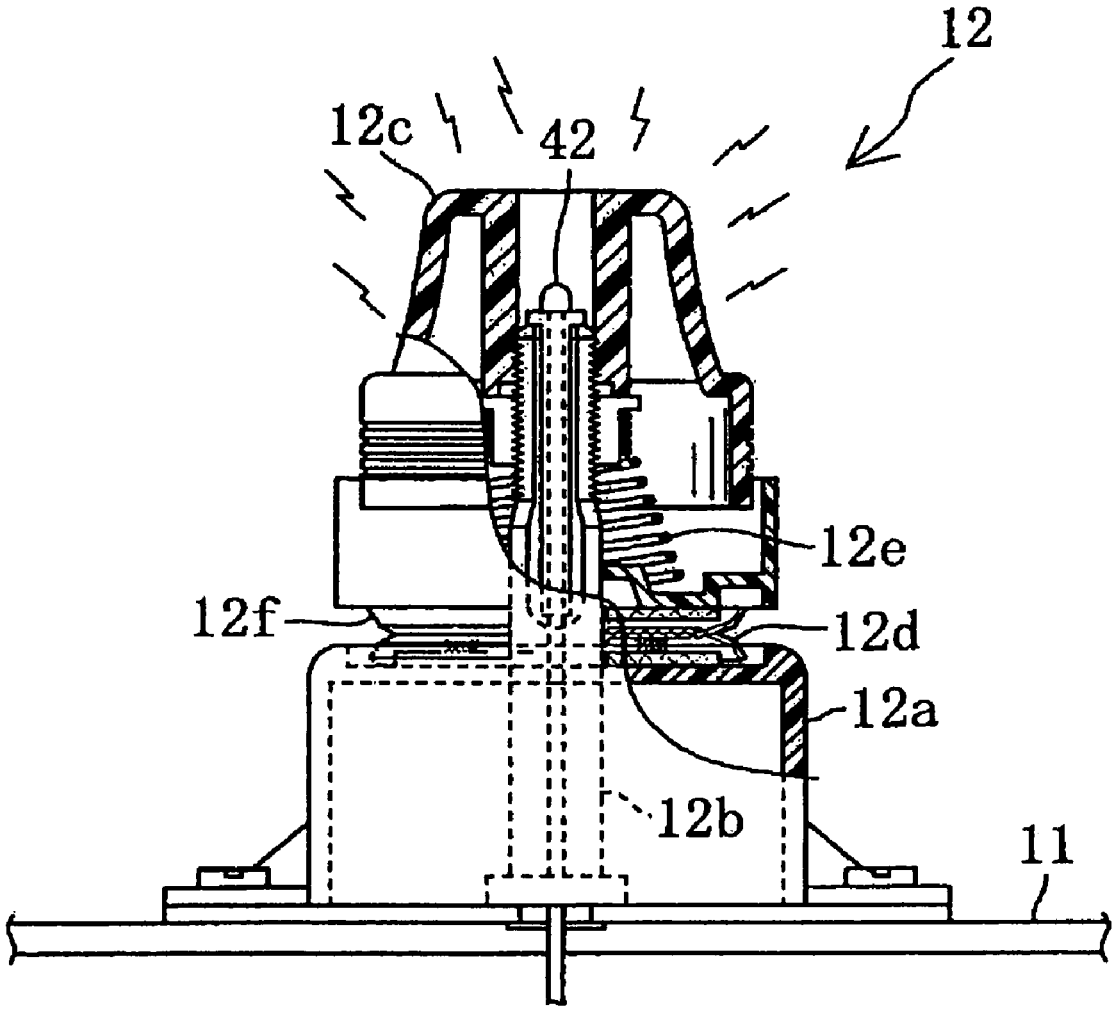
FIG. 3 is a longitudinally sectional front view of a thread tension regulator.

The thread tension regulators 12 to 17 will now be described. Since the six thread tension regulators 12 to 17 have the same construction, only the thread tension regulator 12 will be described. As shown in FIG. 3, the thread tension regulator 12 includes a circular cylindrical thread tension base 12*a* with an upper wall on an upper portion thereof, a thread tension shaft 12*b* standing from a central part of the thread tension base 12*a*, an adjusting knob 12*c* brought into threading engagement with the thread tension shaft 12*b*, a fixed disc 12*d* provided on the upper side of an upper wall of the thread tension base 12*a*, a movable disc 12*f* disposed on the fixed disc 12*d* and a compression coil spring 12*e* which is provided between a lower end of the adjusting knob 12*c* and the movable disc 12*f* so as to bias the movable disc 12*f* toward the fixed disc 12*d* side.

The adjusting knob 12*c* is made from a transparent or translucent synthetic resin. The thread tension shaft 12*b* is hollow and is formed with a through hole (not shown). The through hole has an upper open end in which a first thread tension lamp 42 comprising a full-color LED is provided. The first thread tension lamp 42 produces full-color light when receiving a drive signal from the control device 50 (see FIG. 4) as will be described later. More specifically, upon emission of light from the first thread tension lamp 42, the light passes through the adjusting knob 12*c*, emitting externally. As a result, it appears that the adjusting knob 12*c* produces light. Accordingly, the operator can easily view the colored light emitted from the first thread tension lamp 42 from outside. Similarly, the second to sixth thread tension lamps 43 to 47 comprising full-color LEDs are also provided on the other thread tension regulators 13 to 17, respectively. Accordingly, the operator can easily view the colored light peculiar to each of the thread tension regulators 12 to 17.

Figure 4:
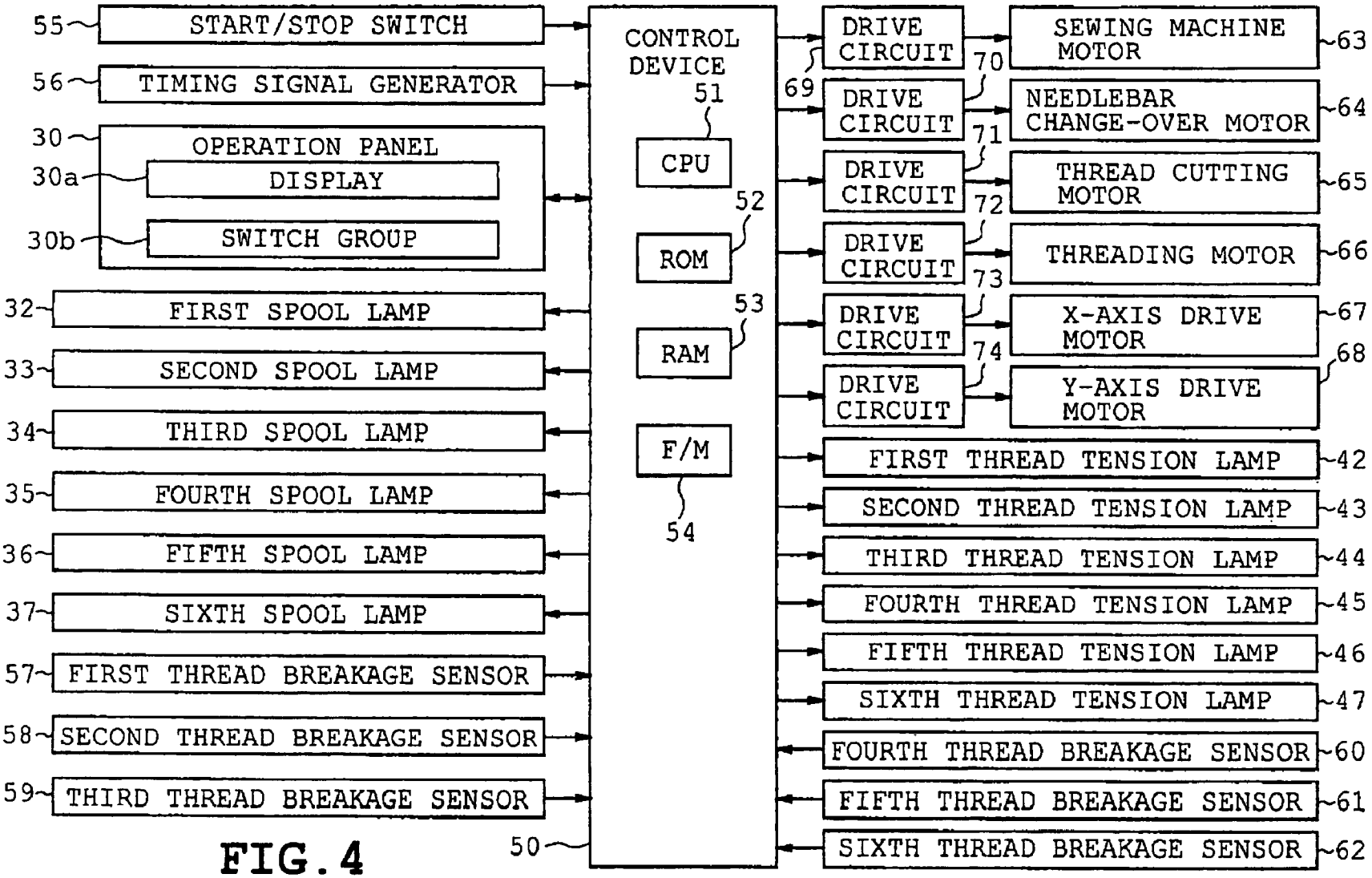
FIG. 4 is a block diagram showing a control system of the multineedle embroidery sewing machine.

The control system of the multineedle embroidery sewing machine M will be described with reference to FIG. 4. The control device 50 controlling the multineedle embroidery sewing machine M comprises a microcomputer including a central processing unit (CPU) 51, a read only memory (ROM) 52, a random access memory (RAM) 53 and an electrically rewritable non-volatile flash memory (F/M) 54. Furthermore, the control device 50 is provided with an input port, an output port and an input/output port none of which are shown. To the input port of the control device 50 are connected a start/stop switch 55, a timing signal generator 56 detecting a rotational position of a sewing machine main shaft and first to sixth thread breakage sensors 57 to 62. The first to sixth thread breakage sensors 57 to 62 are mounted on the thread tension regulators 12 to 17 so as to be capable of detecting breakage of needle threads extending from the thread spools 29 to the thread take-ups 10 individually, respectively although the mounting of the sensors on the respective thread tension regulators is not shown.

To the output port of the control device 50 are connected a drive circuit 69 for a sewing machine motor 63, a drive circuit 70 for the needle bar switching motor 64, a drive circuit 71 for a thread cutting motor 65 driving a thread cutting mechanism, a drive circuit 72 for the threading motor 66 driving a threading mechanism, drive circuits 73 and 74 for X-axis and Y-axis drive motors 67 and 68 provided in the carnage driving mechanism, the first to sixth spool lamps 32 to 37 and the first to sixth thread tension lamps 42 to 47. The operation panel 30 is connected to the input/output port of the control device 50 so that the operation panel 30 and the control device 50 are capable of transmitting and receiving signals therebetween.

Figure 5:
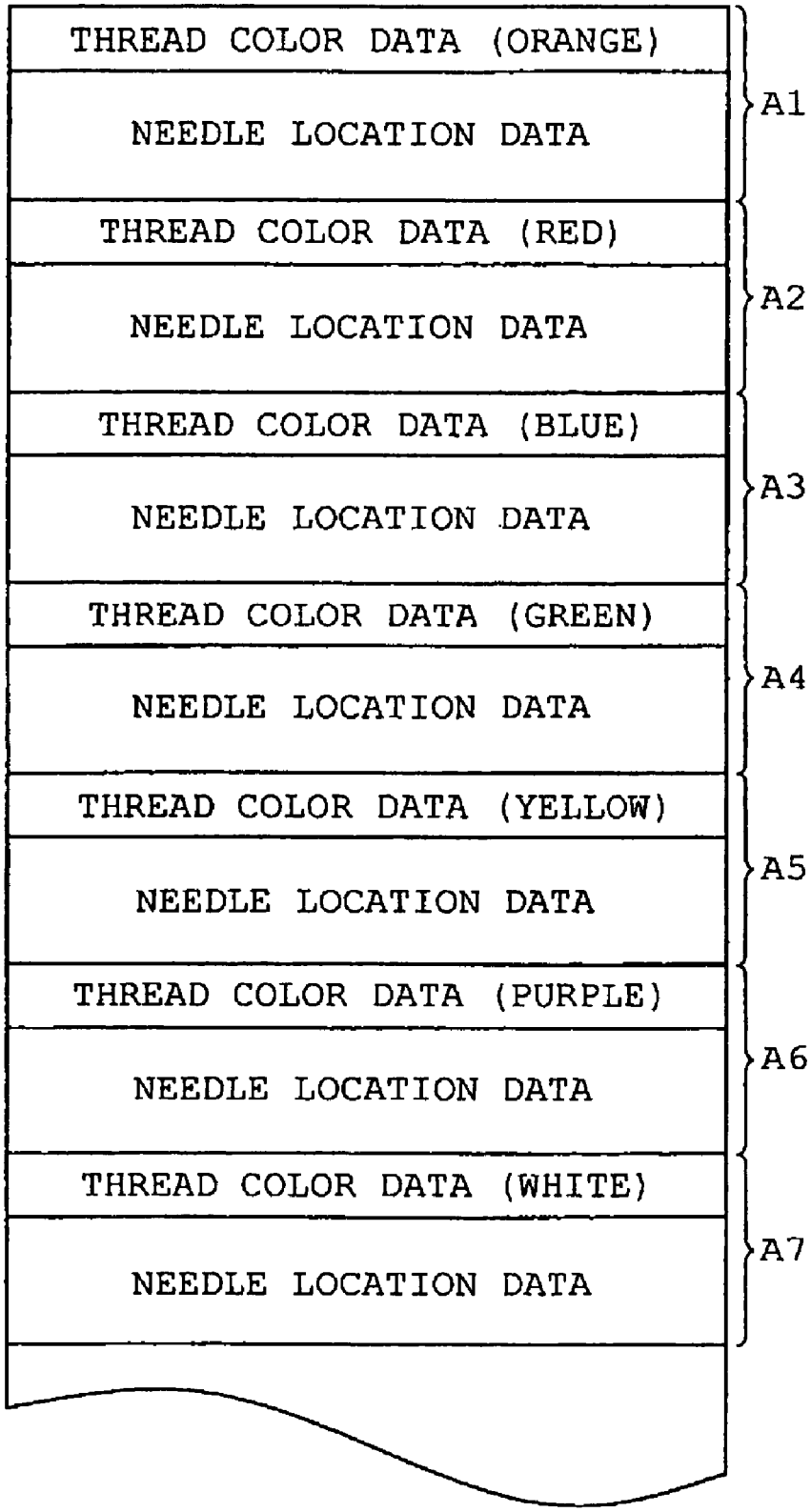
FIG. 5 shows data construction of sewing data.

The ROM 52 stores a drive control program for controlling the motors 63 to 68 for execution of embroidery sewing, a plurality of types of sewing data for embroidery sewing and a processing program for an embroidery sewing process peculiar to the present disclosure as will be described later. Each sewing data includes needle location data indicative of needle locations in the sewing and thread color data indicative of thread colors of needle threads for every sewing area (A1 to A7) on which stitches are continuously formed using the needle thread of the same thread color, as shown in FIG. 5.

The flash memory 54 stores a needle bar thread color table of numbers of the six needle bars 8, that is, sewing needle numbers, corresponding thread colors of needle threads set on the sewing needles 9 of the respective needle bars 8, the corresponding first to sixth spool pin stand lamps 32 to 37 and the corresponding first to sixth thread tension regulator lamps 42 to 47, as shown in FIG. 6. As the thread colors corresponding to the respective sewing needle numbers in FIG. 6, the flash memory 54 stores data of a thread color of the needle thread used for a first embroidery sewing operation in the previous embroidery sewing and data of changed thread colors of the needle threads used for second and third embroidery sewing operations in the previous embroidery sewing and so on. Furthermore, the flash memory 54 stores a colored light table of RGB values which are previously set for every thread color and are provided for producing colored light as various types of thread colors, as shown in FIG. 7.

The RAM 53 is provided with a sewing data memory storing sewing data read from the ROM 52 for sewing execution, sewing thread color memory storing thread color data for sewing execution as shown in FIG. 8 and other necessary memories. The sewing thread color memory of the RAM 53 stores data of all the thread colors included in the sewing data of an embroidery pattern selected from the ROM 52 for the embroidery sewing, the data being read in a sewing sequence in the start of the sewing.

Figure 9A:
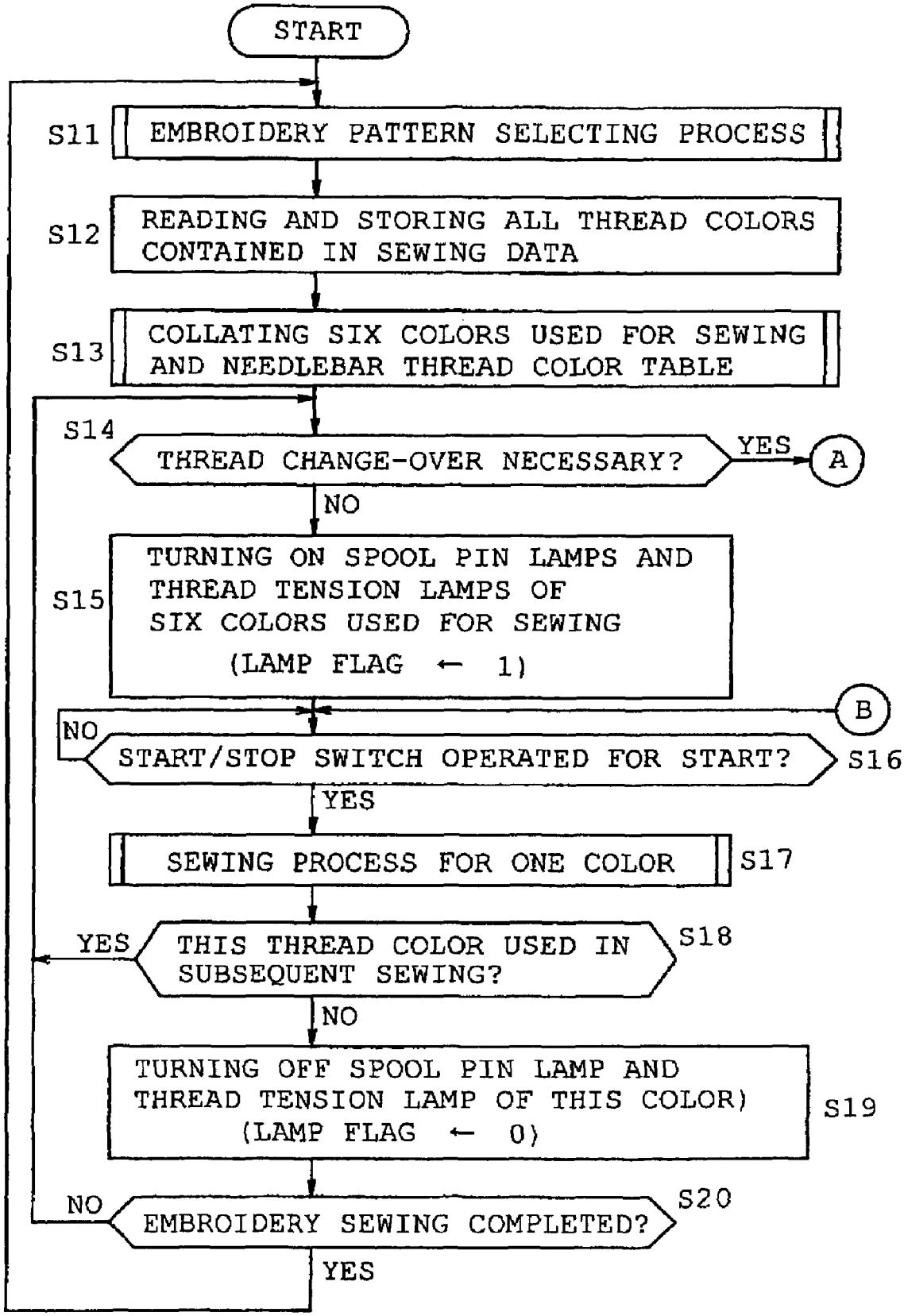
FIGS. 9A and 9B are flowcharts showing an embroidery sewing process.
Figure 9B:
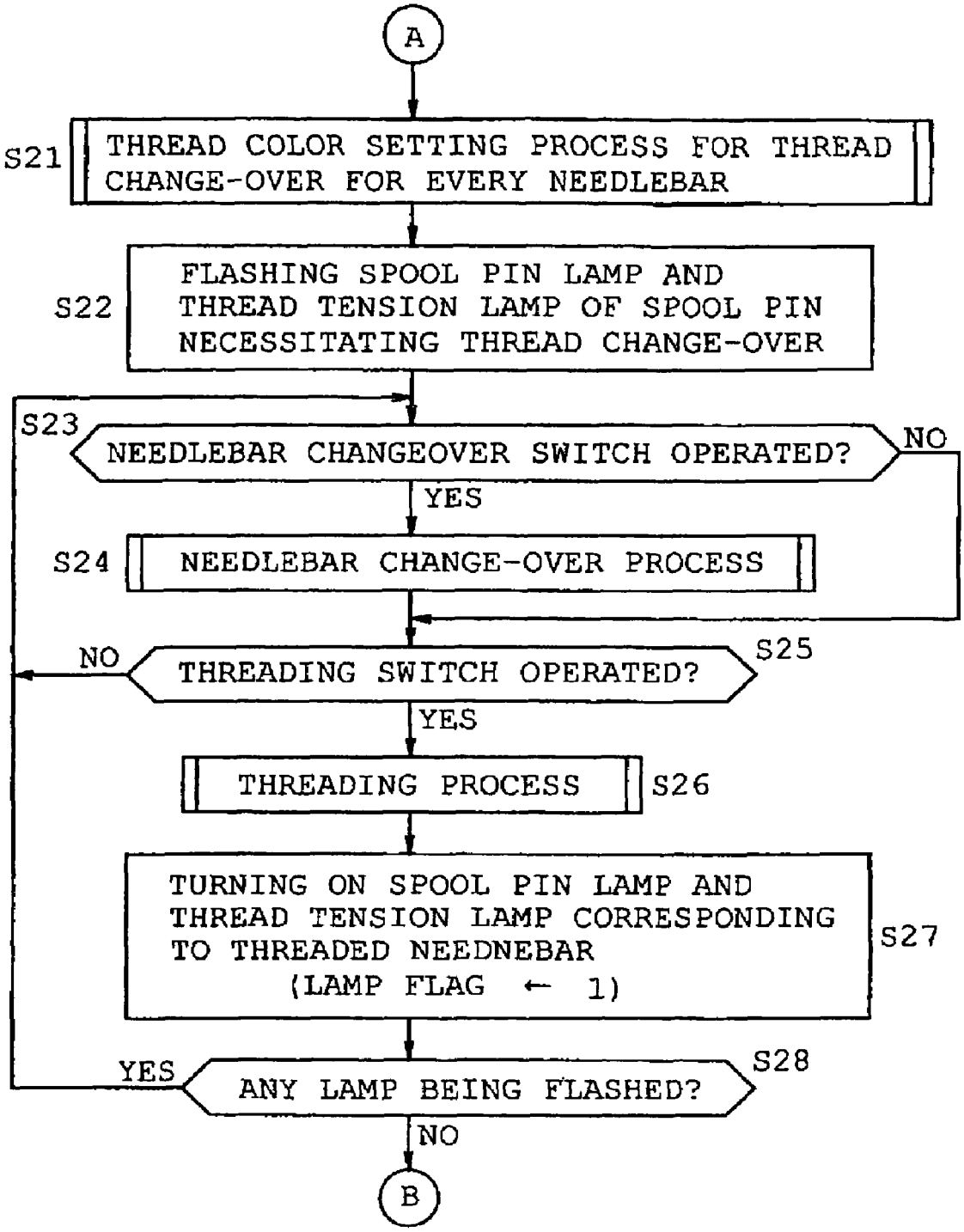

An embroidery sewing process executed by the control device 50 of the multineedle embroidery sewing machine M will now be described with reference to the flowcharts of FIGS. 9A, 9B and 10. In the figures, symbol Si (where i=11, 12, 13 and . . . ) indicates a step. Referring to FIGS. 9A and 9B, the control device 50 firstly controls the display 30*a* so that an embroidery pattern selecting screen is displayed on the display 30*a*, and the operator carries out an embroidery pattern selecting process to select a desired embroidery pattern (S11). Subsequently, based on the sewing data of the selected embroidery pattern, the control device 50 reads all the thread colors included in the sewing data of the selected embroidery pattern from the ROM 52, storing the read data of the thread colors on the sewing thread color memory of the RAM 53 (S12). Furthermore, the control device 50 carries out a process of collating six thread colors for sewing stored on the sewing thread color memory with thread colors at the first embroidery sewing stored on the needle bar thread color table of the flash memory 54 (S13).

In the aforesaid collating process, no thread change is necessary when the read six thread colors (see FIG. 8) to be used in the current embroidery sewing correspond with the six thread colors (see FIG. 6) used in the previous embroidery sewing. When no thread change is necessary (S14: No), the control device 50 turns on the first to sixth spool lamps 32 to 37 corresponding to the six colors to be used in the sewing and first to sixth thread tension lamps 42 to 47 so that the colored light based on the first thread colors of the needle bar thread color table is emitted (S15). In this case, the control device 50 sets a lamp flag which is provided so as to correspond to the first to sixth spool lamps 32 to 37 and first to sixth thread tension lamps 42 to 47 (flag data=1).

Subsequently, when the operator has operated the start/stop switch 55 for start (S16: Yes), the control device 50 sequentially drives the motors so that a sewing process (see FIG. 10) for an initial one color is carried out (S17). In the illustrative example, for example, the sewing needle numbers and the sewing sequence of the used thread colors in the current sewing correspond with those in the previous sewing as shown in FIGS. 6 and 8 when the first six thread colors used in the previous sewing as shown in FIG. 6 correspond with the six thread colors to be used in the current embroidery sewing as shown in FIG. 8.

Figure 10:
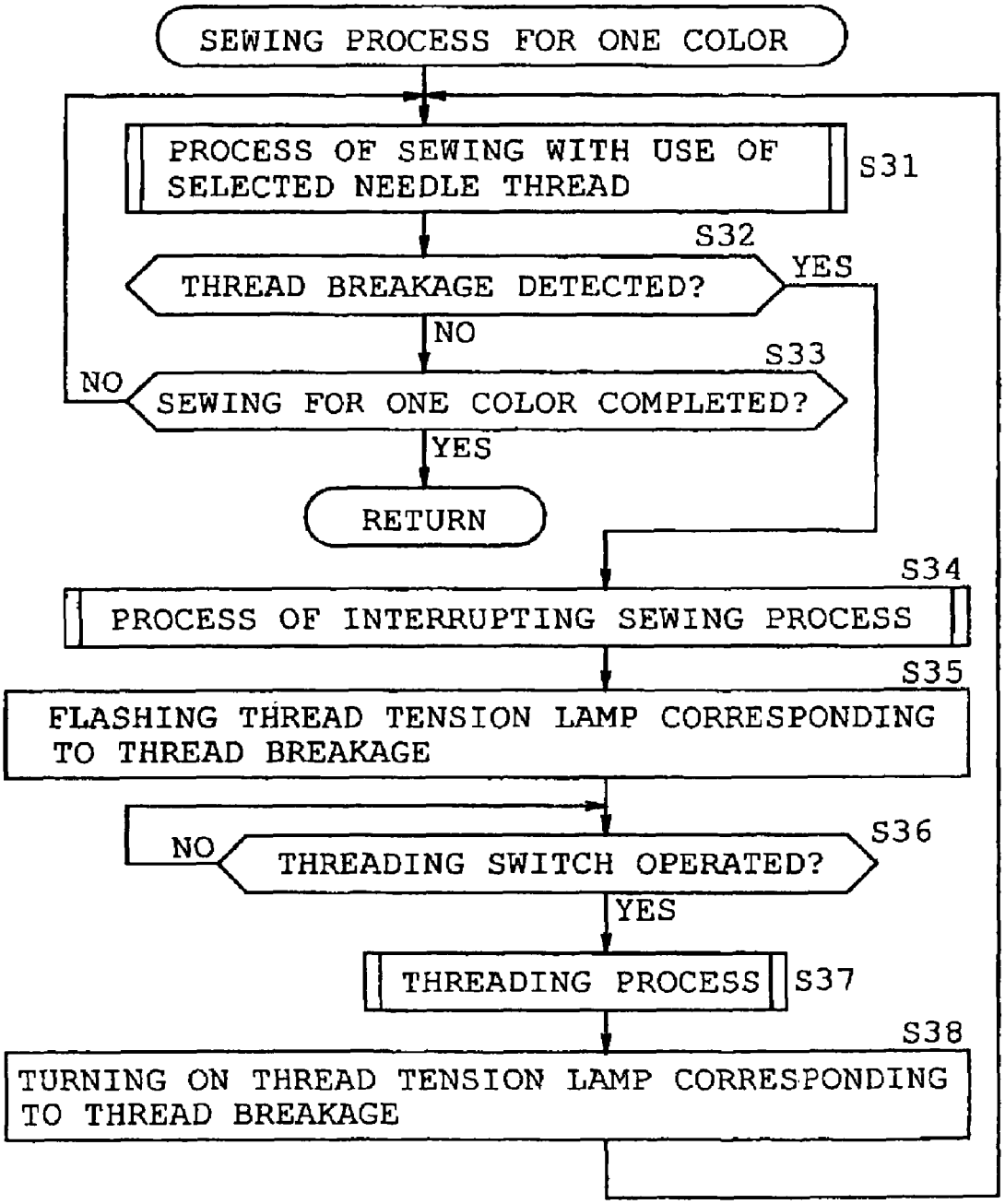
FIG. 10 is a flowchart showing a sewing process for one color.

Referring to FIG. 10, when initiating the sewing process for the one color, the control device 50 controls the needle bar 8 of the selected No. 1 sewing needle 9 so as to be vertically driven. As a result, a sewing process for one stitch is carried out in any one of the sewing areas A1 to A7 in FIG. 5, for example, the sewing area A1 using, for example, the needle thread of orange color supplied to the No. 1 sewing needle 9 (S31). The control device 50 repeats S31 to S33 thereby to carry out the sewing process when the first to sixth thread breakage sensors 57 to 62 supply no thread breakage signal to the control device 50 during the sewing process and the needle thread currently serving for the sewing has no breakage (S32: No) and the sewing process for one color has not been completed (S33: No). The control device 50 returns to S18 of the embroidery sewing process when the sewing process for the one color (orange color) or the sewing process in the sewing area A1 has been completed (S33: Yes).

However, when thread breakage has occurred in the currently used needle thread during the sewing process of the one stitch, the control device 50 receives a thread breakage signal from any one of the thread breakage sensors 57 to 62 corresponding to the needle thread, for example, the thread breakage sensor 57 (S32: Yes). In this case, the control device 50 carries out an interrupting process of stopping drive of the sewing machine motor 63 and the like (S34). Furthermore, the control device 50 changes any one of the thread tension lamps 42 to 47 corresponding to the needle thread with the thread breakage, for example, the thread tension lamp 42 from a lighted state to a flashing state (S35). In this case, when finding occurrence of thread breakage from the flashing display by the thread tension lamp 42, the operator prepares re-threading of the needle thread with the thread breakage occurred. When the operator then operates the threading switch (S36: Yes), the control device 50 carries out a threading process of passing the needle thread through the needle eye of the sewing needle 9 as described above (S37). The control device 50 then turns on the thread tension lamp 42 corresponding to the needle bar 8 of the sewing needle 9 with the needle eye through which the needle thread has been passed so that the thread tension lamp 42 is lighted (S38). Thereafter, the control device 50 carries out S31 to S33 thereby to execute the sewing process from the needle location at the time of occurrence of thread breakage.

Subsequently, in the embroidery sewing process, when the needle thread of the thread color used in the sewing process at S17 is not used in the subsequent sewing after execution of the sewing process for the initial one thread color (S18: No), the control device 50 turns off the spool lamp 32 of the aforesaid thread color and the thread tension lamp 42, resetting the lamp flags of the spool lamp 32 and the thread tension lamp 42 (flag data=0; and S19). When the embroidery sewing process has not been completed (S20: No), the control device 50 repeats S14 and subsequent steps with use of the threads of the second and subsequent thread colors, thereby executing the embroidery sewing process. More specifically, the control device 50 sequentially drives second to sixth needle bars 8 every time advancing to S17, thereby sequentially carrying out with use of the needle threads of, for example, red, blue, green, yellow and purple. When the embroidery sewing process has been completed (S20: Yes), the control device 50 repeats S11 and subsequent steps.

On the other hand, when the needle thread of the thread color used in the sewing process at S17 is used in the subsequent sewing after execution of the sewing process for the initial one thread color (S18: Yes), the control device 50 repeats S14 and subsequent steps without execution of S19.

Thread change is necessary when the six thread colors to be used in the current embroidery sewing do not correspond with the six thread colors used in the previous embroidery sewing. When thread change is necessary (S14: Yes), the control device 50 carries out a thread color setting process for thread change for every needle bar 8 (S21). In the thread color setting process, the control device 50 changes a first thread color of the needle bar thread color table based on data of a thread color stored on the sewing thread color memory. Subsequently, the control device 50 flashes one of the spool lamps 32 to 37 which necessitates thread change and one of the thread tension lamps 42 to 47 which necessitates thread change, based on the first thread color of the new needle bar thread color table in which the thread color has been changed (S22). In this case, the spool lamp and thread tension lamp both flashed emit the colored light of the changed thread color.

The operator then detaches the thread spool 29 corresponding to the flashed one of the spool lamps 32 to 37 and attaches the thread spool 29 corresponding to the flashed thread color to the spool pin stand 20 or 21, thereby preparing for threading. When the operator has operated the needle bar changeover switch so that the needle bar 8 form which the needle thread has been detached is located at a sewing position (S23: Yes), the control device 50 drives the needle bar changing motor 64 so that the needle bar changing mechanism carries out switching of the needle bar (S24). Subsequently, when the operator has operated the threading switch (S25: Yes), the control device 50 drives the threading motor 66 so that the threading mechanism carries out a threading process in which the needle thread is passed through the needle eye of the sewing needle 9 (S26). The control device 50 turns on one of spool lamps 32 to 37 and one of the thread tension lamps 42 to 47 both corresponding to the needle bar 8 having the threaded sewing needle (S27). In this case, the spool lamp and the thread tension lamp are lighted with respective colored light. Also, in this case, too, the control device 50 sets the lamp flags of the lighted lamps (flag data=1).

Subsequently, when one of the spool lamps 32 to 37 and one of the thread tension lamps 42 to 47 are flashed at S22 (S28: Yes), the control device 50 repeats S23 to S28. On the other hand, when no spool lamps 32 to 37 and no thread tension lamps 42 to 47 are flashed (S28: No), needle threads of six thread colors to be used in the subsequent sewing have been passed through the needle bars 8 respectively. Accordingly, the control device 50 carries out S16 and subsequent steps.

The following describes an operation for displaying a thread color of the needle thread in the embroidery sewing process. When the operator selects an embroidery pattern on a screen of the display 30*a*, the control device 50 reads out all the thread colors included in the embroidery data of the selected embroidery pattern, storing the read data on the sewing thread color memory of the RAM 53 in the order of readout. In this case, the control device 50 checks whether all the initial six thread colors stored on the sewing thread color memory have already stored on the needle bar thread color table of the flash memory 54.

More specifically, since six thread colors used in the previous embroidery sewing have been set in the needle bar thread color table, the control device 50 collates the thread colors on the sewing thread color memory with the six thread colors on the needle bar thread color table. As the result of collation, for example, in one case, the sewing thread color memory stores seven colors (orange, red, blue, green, yellow, purple and white) as shown in FIG. 8 and the six thread colors set in the needle bar thread color table and used in the previous initial time are orange, red, blue, green, yellow and purple as shown in FIG. 6. In this case, the six of seven thread colors for the initial time correspond with the thread colors used in the previous initial time. However, as shown in FIG. 8, the currently used seventh thread color (an initial color used in a second embroider sewing operation) is white, which differs from the thread color, "orange", indicated by sewing needle number 1 in the first embroidery sewing operation. Accordingly, the control device 50 changes to "white" the needle thread of the needle bar 8 corresponding to the sewing needle 9 of needle No. 1. The control device 50 then flashes the first spool lamp 32 and first thread tension lamp 42 both corresponding to the needle bar 8 of the sewing needle 9 of needle No. 1. In this case, both lamps 32 and 42 emit colored light of white.

The operator then detaches the thread spool 29 on the spool pin 22*b* of the spool pin stand 20 indicated by flashed light of white and attaches a thread spool 29 of white, thereby preparing for threading. The operator then operates the needle bar change-over switch. When the needle bar 8 of No. 1 sewing needle 9 has been selected, the operator operates the threading switch so that the needle thread of while is passed through the needle eye of the sewing needle 9. In this case, too, the operator can easily perceive the thread color to be changed by the colored light of white. Moreover, it can easily be perceived in which spool pins 22*b* to 27*b* of the first and second spool pin stands 20 and 21 the thread spool 29 should be changed. As a result, a correct one of the thread tension regulators 12 to 17 can be threaded.

When the needle bar thread color table of the previously used thread colors as shown in FIG. 6 stores none of the thread colors to be currently used, the control device 50 sets a first thread color, a second thread color, a third thread color and so on in the needle bar thread color table based on a plurality of thread colors stored on the sewing thread color memory in FIG. 8. Firstly, the control device 50 turns on first to sixth spool lamps 32 to 37 and first to sixth thread tension lamps 42 to 47 so that the lamps 32 to 37 and 42 to 47 emit colored light based on the six thread colors set as the initial thread colors respectively. Accordingly, the operator can correctly attach the thread spools 29 of a plurality of colors to be used in the embroidery sewing to the spool pins 22*b* to 27*b* respectively. Moreover, the thread tension regulators 12 to 17 corresponding to the spool pins 22*b* to 27*b* can correctly be threaded respectively.

As obvious from the foregoing, the multineedle embroidery sewing machine M comprises the needle bars 8 corresponding to a plurality of the sewing needles 9 provided for the sewing operation with use of a plurality of the needle threads, the first and second spool pin stands 20 and 21 each having a plurality of the spool pins 22*b* to 27*b* to which a plurality of the thread spools 29 corresponding to the needle bars 8 are attached respectively and a plurality of the thread tension regulators 12 to 17 provided on the thread passages leading from the spool pin stands 20 and 21 to the needle bars 8. The multineedle embroidery sewing machine M further comprises the ROM 52 storing sewing data and the first to sixth spool lamps 32 to 37 and the control device 50. In sewing a selected embroidery pattern, based on thread color data included in the sewing data, the control device 50 turns on the spool lamps 32 to 37 corresponding to a plurality of the spool pins 22*b* to 27*b* respectively so that the spool lamps 32 to 37 emit colored light of respective thread colors thereby to perform a displaying function. Accordingly, the operator can easily and exactly attach, to the spool pins 22*b* to 27*b* with respective thread colors displayed, the thread spools 29 of the same colors as indicated by thus displayed colored light without confusion among the other spool pins 22*b* to 27*b*.

A plurality of the thread tension regulators 12 to 17 are provided with the first to sixth thread tension lamps 42 to 47 respectively. Based on the thread color data included in the sewing data read from the ROM 52, the control device 50 turns on the first to sixth thread tension lamps 42 to 47 so that the lamps 42 to 47 emit the colored light of the thread colors corresponding to the spool pins 22*b* to 27*b*, thereby performing the displaying function. Accordingly, the operator can easily and exactly attach, to the thread tension regulators 12 to 17 with respective thread colors displayed, the thread spools 29 of the same colors as indicated by thus displayed colored light without confusion among the thread tension regulators 12 to 17.

Furthermore, the control device 50 changes the display modes of the spool lamps 32 to 37 from the lighting to the flashing according to the degree of preparation of the thread spools 29 attached to the first and second spool pin stands 20 and 21. Accordingly, the display mode is changed to the flashing even when the thread spools 29 are attached to the spool pins 22*b* to 27*b* as preparation before start of the sewing process, respectively or the thread spools 29 are changed during the sewing. Consequently, the operator can easily and quickly attach the thread spools 29 to the spool pins 22*b* to 27*b* which are displayed in a display modes differing from ordinary modes without confusion.

Furthermore, the first to sixth spool lamps 32 to 37 and first to sixth thread tension lamps 42 to 47 comprise full-color LEDs which are capable of emitting colored light of a plurality of colors, respectively. Accordingly, since colored light of a number of colors can be used in the displaying function, a number of thread colors can be indicated and the operator can plainly recognize the thread colors of the thread spools 29 to be attached to the spool pins 22*b* to 27*b* respectively and the colors of threads to be supplied to the thread tension regulators 12 to 17 respectively. Furthermore, since the first to sixth spool lamps 32 to 37 and first to sixth thread tension lamps 42 to 47 each comprising LED can be rendered smaller in size and are advantageous in an installation space and costs.

Figure 11:
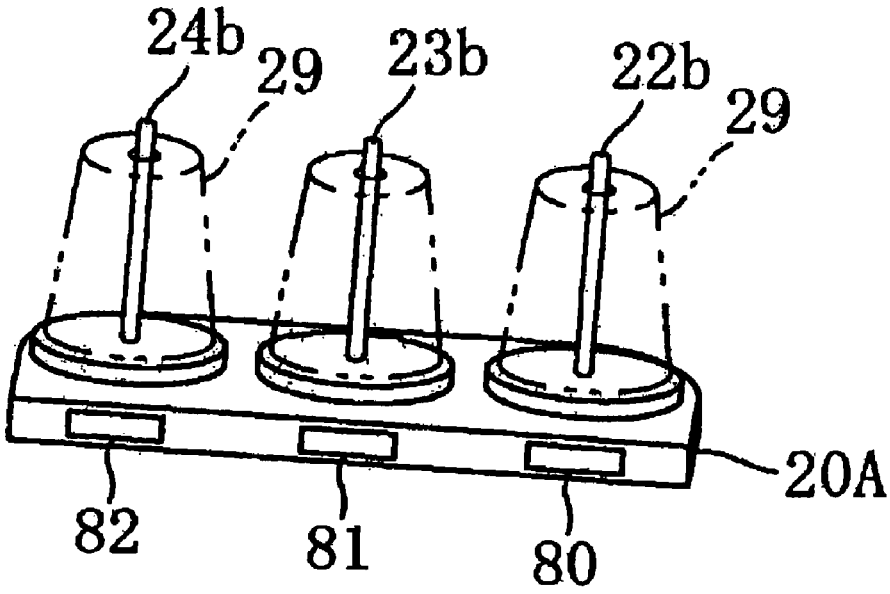
FIG. 11 is a perspective view of the spool pin stand of a second illustrative example in accordance with the present disclosure.
Figure 12:
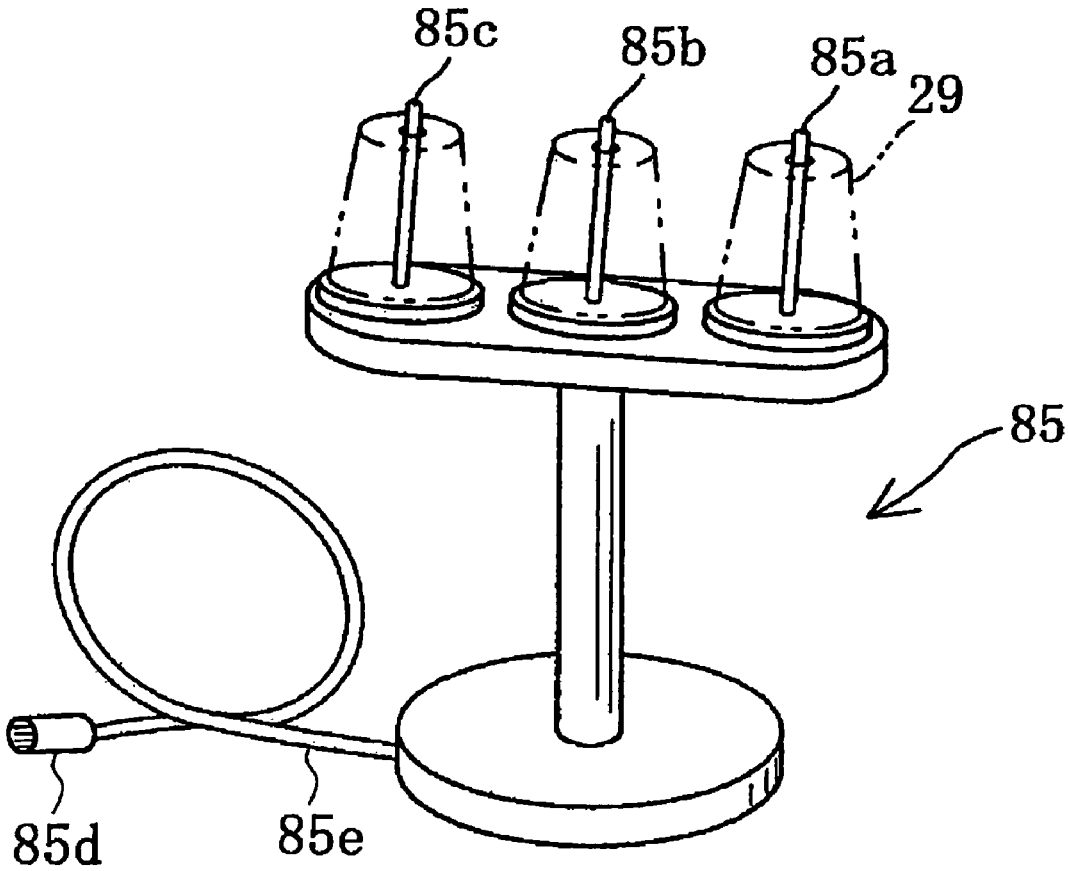
FIG. 12 is a perspective view of the spool pin stand of a third illustrative example in accordance with the present disclosure.

FIGS. 11 and 12 illustrate second and third illustrative examples of the present disclosure respectively. Only the difference of each example from the first example will be described in the following.

In the multineedle embroidery sewing machine M of the second illustrative example as shown in FIG. 11, the first spool pin stand 20A is provided with no full-color LED. Small liquid crystal displays 80 to 82 are built in the first spool pin stand 20A so as to correspond to the spool pins 22*b* to 24*b* respectively. Each of the displays 80 to 82 is capable of displaying the names of thread colors, color numbers and the like of the thread spools 29 as character information. In this case, the operator can exactly recognize the names of thread colors, color numbers and the like of the thread spools 29 to be attached to the respective spool pins 22*b* to 24*b* by the character information. In particular, even when a plurality of thread spools 29 which are very similar to each other or one another, the operator can attach the thread spools 29 to the respective spool pins 22*b* to 24*b* easily and exactly without error. The small liquid crystal displays may also be built into the second spool pin stand 21 in the same manner as the first spool pin stand 20A although not shown in the drawings.

Each of the liquid crystal displays 80 to 82 may be a color liquid crystal display. In this case, since thread colors can be color-displayed as well as the character information, visibility can further be improved.

FIG. 12 shows a spool pin stand 85 of the third example. The spool pin stand 85 has a plurality of spool pins 85*a* to 85*c* which are provided independent of the multineedle embroidery sewing machine M. Of course, in this case, too, the spool lamps (not shown) comprising respective aforesaid full-color LEDs are provided in the spool pin stand 85 having the spool pins 85*a* to 85*c*.

The spool pin stand 85 has a connector 85*d* connectable to a connector (not shown) of the multineedle embroidery sewing machine M and a connecting code 85*e*. Thread color display data may be received from the multineedle embroidery sewing machine M. Furthermore, the spool pin stand 85 may be arranged so as to be supplied with power and data from another multineedle embroidery sewing machine.

The ROM 52 of the multineedle embroidery sewing machine M may store sewing data in the same manner as in the first illustrative example. Based on thread color information read from the ROM 52, the control device 50 may control a plurality of spool lamps so that a plurality of thread colors corresponding to the respective spool pins 85*a* to 85*c* are displayed by the spool lamps. In this case, too, since the thread color display data is received from the multineedle embroidery sewing machine M, a plurality of spool lamps are displayed by a plurality of thread colors corresponding to a plurality of spool pins 85*a* to 85*c*. Accordingly, the operator can easily and exactly attach, to the spool pins 85*a* to 85*c* with respective thread colors displayed, the thread spools 29 of the same colors as indicated by thus displayed colored light without confusion among the spool pins 85*a* to 85*c*.

Since the spool pin stand 85 is provided with full-color LEDs which are light-emitting units capable of emitting colored light of a plurality of colors, colored light of a number of colors can be displayed and accordingly, a number of thread colors can be indicated and the operator can plainly recognize the thread colors of the thread spools 29 attached to the respective spool pins 85*a* to 85*c*.

Furthermore, the spool pin stand 85 constructed as described above can be purchased as an optional part as the operator demands. Still furthermore, the spool pin stand 85 may be connected to single-needle embroidery sewing machines, household sewing machines which can sew embroidery patterns, sewing machines which can carry out ordinary sewing or the like.

Furthermore, liquid crystal displays may be provided instead of the spool lamps. In this case, the operator can exactly recognize the names of thread colors, color numbers and the like of the thread spools 29 to be attached to the respective spool pins 85*a* to 85*c* by the character information. In particular, even when a plurality of thread spools 29 to be attached to the respective spool pins 22*b* to 24*b* are very similar to each other or one another, the operator can attach the thread spools 29 to the respective spool pins 22*b* to 24*b* easily and quickly without error.

The present disclosure should not be limited to the foregoing illustrative examples. The illustrative examples may be modified or expanded as follows. Although the foregoing first to sixth spool lamps 32 to 37 and first to sixth thread tension lamps 42 to 47 comprise respective full-color LEDs in the foregoing examples, these lamps 32 to 37 and 42 to 47 may comprise various light-emitting devices or displays such as color lamps, organic electroluminescent (EL) displays, plasma displays, electronic paper or the like, so that the thread colors may be displayed in a variable manner by colored light or character information.

Various displays such as organic EL displays, plasma displays, electronic paper or the like may be employed, instead of the liquid crystal displays 80 to 82.

The foregoing description and drawings are merely illustrative of the principles of the present disclosure and are not to be construed in a limiting sense. Various changes and modifications will become apparent to those of ordinary skill in the art. All such changes and modifications are seen to fall within the scope of the invention as defined by the appended claims.

What is claimed is:

1. A sewing machine comprising:

a plurality of needle bars provided for a sewing operation using a plurality of needle threads;

a spool pin stand having a plurality of spool pins to which a plurality of thread spools corresponding to the needle bars are attachable and a plurality of seats which are provided so as to correspond to the spool pins, respectively;

a plurality of thread passage defining members defining a thread passage extending from the spool pin stand to the needle bars;

a sewing data storage unit which stores sewing data including at least thread color information about colors of the needle threads;

a plurality of thread supply display units which are provided on the spool pin stand so as to correspond to the spool pins respectively, the thread supply display units being configured to produce light which transmits through at least ones of the spool pins and the seats and displaying the thread colors in a color-variable manner, respectively; and a thread color information display control unit which controls the thread supply display units based on the thread color information read from the sewing data storage unit, so that a plurality of thread colors corresponding to the spool pins are displayed by the thread supply display units, respectively.

2. The sewing machine according to claim 1, further comprising a plurality of thread passage display units which are provided on or near the thread passage defining members respectively, wherein the thread color information display control unit controls the thread passage display units based on the thread color information read from the sewing data storage unit, so that a plurality of thread colors corresponding to the spool pins are displayed by colored light by the thread passage display units, respectively.

3. The sewing machine according to claim 2, wherein each thread passage display unit comprises a light-emitting device which is capable of emitting light colored with a plurality of colors.

4. The sewing machine according to claim 3, wherein the light-emitting device comprises a full-color LED.

5. The sewing machine according to claim 1, wherein the thread color information display control unit controls the thread supply display units so that display modes are changed according to states of the thread spools prepared onto the spool pin stand.

6. The sewing machine according to claim 1, wherein each thread supply display unit comprises a light-emitting device which is capable of emitting light colored with a plurality of colors.

7. The sewing machine according to claim 6, wherein the light-emitting device comprises a full-color LED.

8. The sewing machine according to claim 1, wherein each thread supply display unit comprises an additional display capable of displaying a name of each thread color as character information.

9. A spool pin stand for use with a sewing machine including a plurality of needle bars provided for a sewing operation using a plurality of needle threads, the spool pin stand comprising:

a plurality of spool pins to which a plurality of thread spools corresponding to the needle bars are attachable, respectively;

a plurality of seats which are provided so as to correspond to the spool pins respectively; and a plurality of thread color display units which display thread colors in a color-variable manner so that the thread colors correspond to the spool pins, respectively, the thread supply display units being configured to produce light which transmits through at least ones of the spool pins and the seats.

10. The spool pin stand according to claim 9, wherein the sewing machine includes a thread color display control unit which controls the thread color display units and a sewing data storage unit which stores sewing data including at least thread color information about colors of the needle threads, and the thread color display control unit controls the thread color display units based on the thread color information read from the sewing data storage unit, so that a plurality of thread colors corresponding to the spool pins are displayed by the thread color display units, respectively.

11. The spool pin stand according to claim 10, wherein each thread color display unit comprises a light-emitting device which is capable of emitting light colored with a plurality of colors.

12. The spool pin stand according to claim 11, wherein the light-emitting device comprises a full-color LED.

13. The spool pin stand according to claim 9, wherein each thread color display unit comprises an additional display capable of displaying a name of each thread color as character information.

* * * * *